United States Patent [19]

Kojima et al.

[11] Patent Number: 4,930,207

[45] Date of Patent: Jun. 5, 1990

[54] METHOD AND APPARATUS FOR CONTINUOUS COMPRESSION FORGING OF CONTINUOUSLY CAST STEEL

[75] Inventors: Shinji Kojima, Okayama; Toshitane Matsukawa, Kurashiki; Hisakazu Mizota, Okayama; Susumu Yuhara, Kurashiki; Yoshio Yoshimoto; Toshio Fujimura, both of Okayama; Kunihiro Ito, Kobe, all of Japan

[73] Assignee: Kawasaki Steel Corp.

[21] Appl. No.: 356,125

[22] Filed: May 24, 1989

Related U.S. Application Data

[63] Continuation-in-part of Ser. No. 71,412, Jul. 9, 1987, abandoned.

[30] Foreign Application Priority Data

Jun. 7, 1988 [JP] Japan ..... 63-138472
Jun. 30, 1988 [JP] Japan ..... 63-163822

[51] Int. Cl.[5] ..... B21B 1/46

[52] U.S. Cl. ..... 29/527.5; 72/402; 164/468; 164/476

[58] Field of Search ..... 29/527.5; 72/402, 403; 164/417, 476

[56] References Cited

FOREIGN PATENT DOCUMENTS 49-12738 2/1974 Japan .
52-54623 5/1977 Japan .
58-186882 10/1983 Japan .
59-202145 11/1984 Japan ..... 164/476
60-82257 5/1985 Japan .
148651 8/1985 Japan ..... 164/468
61-222663 10/1986 Japan .
63-49400 3/1988 Japan .

*Primary Examiner*—Carl J. Arbes
*Attorney, Agent, or Firm*—Austin R. Miller

[57] ABSTRACT

A method of continuous compression forging, with a compression forging anvil, the final solidified region of cast steel drawn out from a mold for continuously casting, comprising the step of: compressing said cast steel with said anvil at a compressing cycle which meets the following conditions:

$$t \leqq \frac{1}{2Vc\tan\theta}\left(\delta - 0.06\sqrt{D - 80}\right)$$

where t: the compressing cycle (sec), δ: the overall thickness reduction, Vc: the casting speed (mm), D: the cast steel thickness before compression forging, θ: the inclination angle (°) with respect to the flat surface of the anvil.

An apparatus for continuous compression forging continuously cast steel comprising: at least a pair of anvils for vertically holding the pass line of cast steel drawn out from a mold for continuous casting and continuously compression-forging the final solidified region of the moving cast steel by moving the anvils toward and away from each other; a frame; a slider; and links, wherein either of said anvils is disposed within said frame which has a port through which said cast steel is introduced, another anvil is secured to said slider which can be reciprocated along a sliding surface formed in said frame, and said frame and said slider are hung from a crank shaft via said links, said crank shaft acting to move said anvils toward and away from each other.

10 Claims, 12 Drawing Sheets

FIG. 1 (SECTION L)
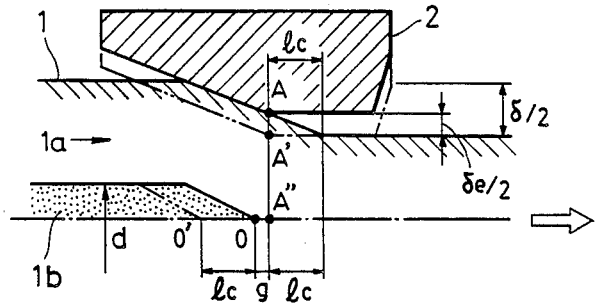
FIG. 2 (SECTION C)
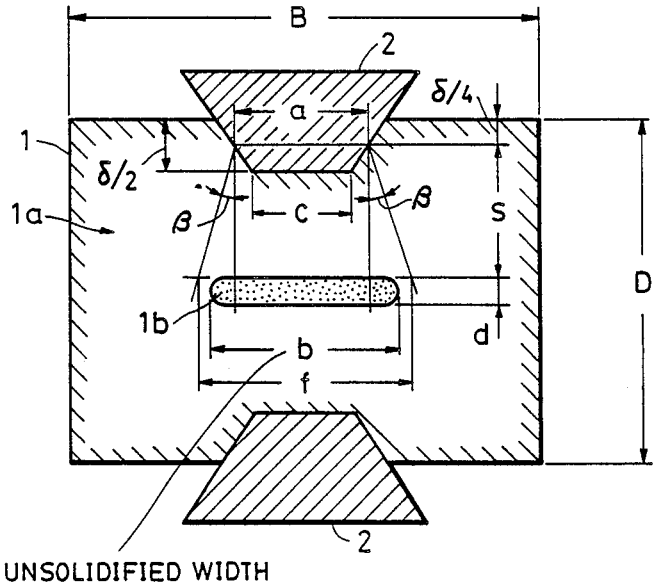

FIG. 3 (SECTION L)
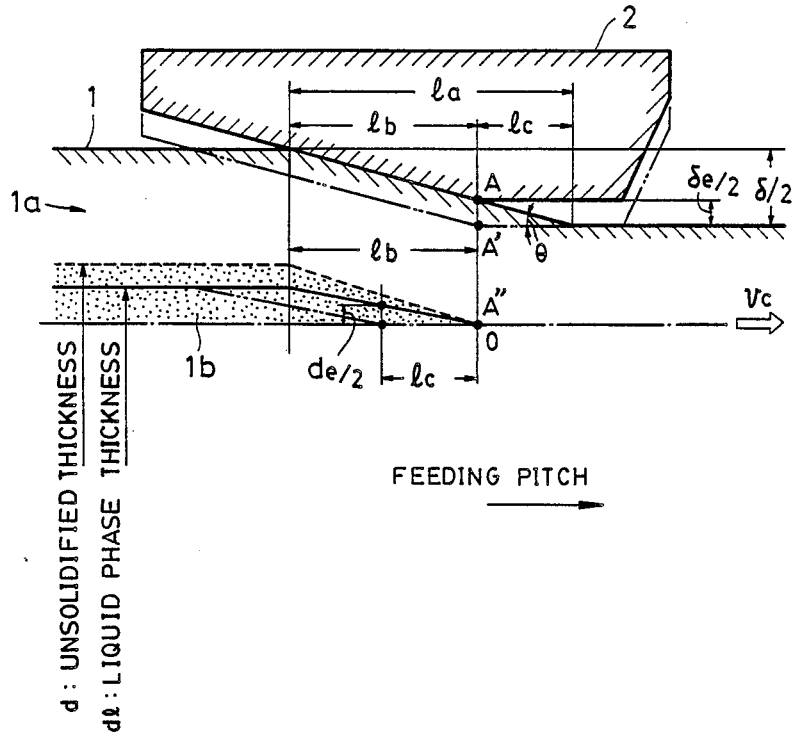

METHOD AND APPARATUS FOR CONTINUOUS COMPRESSION FORGING OF CONTINUOUSLY CAST STEEL

Applicant is a named inventor in parent U.S. application Ser. No. 071,412, filed July 9, 1987, now abandoned of which this is a continuation-in-part, and assigned to Kawasaki Steel Corporation of Kobe, Japan, the same assignee of this application.

BACKGROUND OF THE INVENTION

1. Field of the Invention

The present invention relates to a method and an apparatus for continuous compression forging cast steel derived from the continuous casting process. More specifically, the present invention relates to a method and an apparatus for improving the internal quality of cast steel, and, more particularly, for overcoming defects in casting such as central segregation and center porosity by performing effective compression forging at temperatures below the solidification point of the cast steel obtained by continuous casting.

2. Description of the Prior Art

In the conventional art, forming central segregation in continuously cast steel has been regarded as inevitable. This central segregation is caused by the condensation of carbon, sulfur, and phosphorous in the molten metal in the central portion of the final solidification region of the cast steel. The thus-condensed components in the molten metal appear in the form of normal segregation, causing central segregation which can deteriorate the mechanical properties in the direction of the thickness of steel plates and thus generate laminations.

Segregation in cast steel is considered unavoidable since the condensed molten steel is sucked into the leading end portion of the solidified region of the billet obtained by continuous casting and is allowed to remain as normal segregation in the thicknesswise central portion of the cast steel. The above-described suction of the condensed molten steel can be realized due to: solidification shrinkage of continuously cast steel at the front portion of the solidified region thereof; and a vacuum suction force generated due to bulging of the solidified shell.

In order to prevent central segregation, a variety of ways have been attempted, for example, electromagnetically stirring the second cooling zone. However, such attempts failed to completely eliminate semi-micro segregations and the effect obtained has not been satisfactory as yet.

Furthermore, an in-line reduction method (see "Iron and steel" Vol. 7, 1974, p. 875 to 884) has been proposed in which the cast steel is subjected to a heavy compression at the final stage of the solidification process by using a pair of rollers. However, if the portion of the cast steel containing a relatively large proportion of unsolidified layer is not sufficiently compressed, cracks can form on the interface between the solidified steel and the still molten portion. If excessive compression is applied, a strong negative segregation can be adversely generated in the central portion of the thickness of the cast steel.

In order to overcome the above-described problems, a continuous casting method has been disclosed in Japanese Patent Laid-Open No. 49-12738 in which the front end portion of the solidified region of the cast steel is subjected to a light compression by using pairs of rollers as to compensate for the volume of solidification shrink at the subject portion by this compression. Another method has been proposed in Japanese Patent Laid-Open No. 52-54623 in which an anvil is used for the purpose of having the portion in the vicinity of the region of the cast steel subjected to a heavy compression near the completion of the solidification of the cast steel. The other method has been disclosed in Japanese Patent Laid-Open No. 60-148651 in which electromagnetic stirring is performed, or ultra-sonic waves are applied to the cast steel during the solidification, and compression forging is performed near the completion of the solidification of the cast steel.

However, in a case of such light compression, even if a plurality of pairs of rollers are used to perform the light compression by several millimeters per meter, solidification shrinkages and bulgings generated in the region corresponding to the pitch between the rollers cannot be sufficiently prevented from being generated. Furthermore, if the compression is not applied to the proper position, the central segregation becomes worsened. According to the method in which an anvil is used for heavy-compressing the cast steel at its completion of the solidification, the interface between the solidified steel and the still molten portion can protect against cracking and negative segregation can be satisfactorily prevented from generation compared with the heavy compression method such as the inline-reduction method in which rollers are used, causing even the semi-macro segregation can be overcome. However, if the compression is insufficient in the region of the cast steel in which the unsolidified portion is in a great proportion, cracks can be formed on the interface between the solidified steel and the still molten portion. If the compression is performed excessively, intense negative segregation can be generated in the central portion of the cast steel. In addition, even if the portion of the cast steel in which unsolidified region is reduced is subjected to the compression, any effect cannot be obtained from this compression. Thus, the most suitable compressing conditions have not been as yet established to be performed.

Furthermore, according to the method in which the electromagnetic stirring and the compression forging or application of ultrasonic waves and the compression forging are combined, although an equiaxed crystal ratio can be increased, which assist to reduce the negative segregation, generation of negative segregation cannot be prevented simply by the increase in the equiaxed crystal ratio over the wide conditions upon the thickness of the unsolidified region, casting speed, and temperatures.

In order to overcome the above-described problems, a group including the inventor of the present invention has disclosed a method in Japanese Patent Laid-Open No. 60-82257 in which a compression-forging anvil is used for the purpose of compressing the cast steel near the completion of the solidification of the same. A patent application was applied for under U.S. Ser. No. 071,412, filed July 9, 1987, of which this application is a continuation-in-part. The present invention is based on the former application, but the claimed improvment has been added.

Hitherto, a hydraulic press system has been usually used as a continuously compression-forging machine employed in each countermeasures taken against the above-described central segregation of the continuously cast steel. For example, a method is disclosed in Japanese Patent Laid-Open No. 63-49400 in which an integrally formed frame of a "Floating Type" includes upper and lower anvils so that compression is equally applied from the upper portion by using a single hydraulic cylinder. Furthermore, a scissors method is disclosed in Japanese Patent Laid-Open No. 61-222663 in which a boosting mechanism such as lever is used.

However, the conventional devices of the hydraulic type need a great size hydraulic pressure source and pipes to be provided, causing cost required for institution and the load for maintenance becomes too large. In addition, since such device involves a relative high pressure to be used, the life of the pump and the same of the hydraulic control valve is shortened to two or three years, and the involved noise can exceed B 100 phons of loudness level. Another problem arises in that the energy loss during transference of the hydraulic pressure obtained by converting electric energy from the pump chamber to the compression forging device becomes 20 to 30%. Therefore, the above-described devices have not been satisfactory as yet in terms of the running cost.

OBJECTS OF THE INVENTION

An object of the present invention is to provide a method and an apparatus which are able to overcome the conventional problems which have arisen when cast steel obtained by continuous casting is subjected to compression forging at a point near the solidification point of the cast steel, that is, in the final solidification region formed by an unsolidified portion and the completely solidified portion, which method and apparatus are advantageously used for manufacturing cast steel of an excellent quality.

THE DRAWINGS

The foregoing and other objects of the invention, including the simplicity and economy of the same, and the ease with which it may be adopted to a variety of continuous compression forging operations, will further become apparent hereinafter and in the drawings, of which:

FIG. 1 is a schematic view which illustrates conditions which cause internal cracks in the longitudinal direction of continuously cast steel;

FIG. 2 is a cross-sectional view of continuously cast steel in the widthwise direction;

FIG. 3 is a cross-sectional view of continuously cast steel in the longitudinal direction;

Figure 9B:
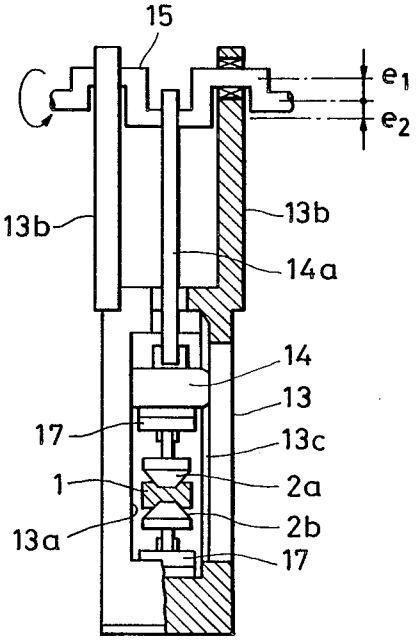
Figure 9A:
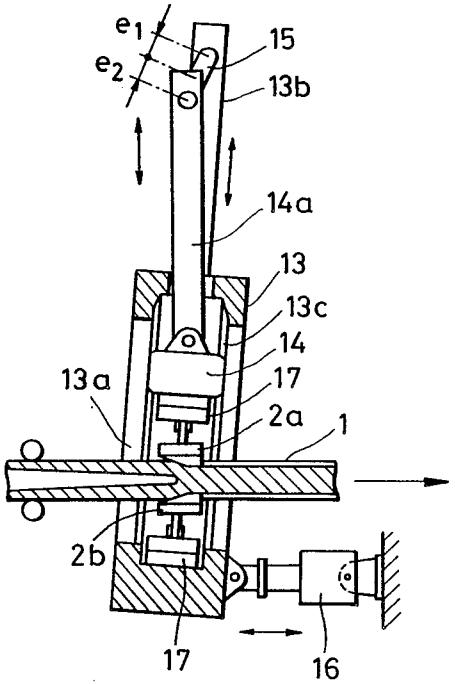
Figure 10:
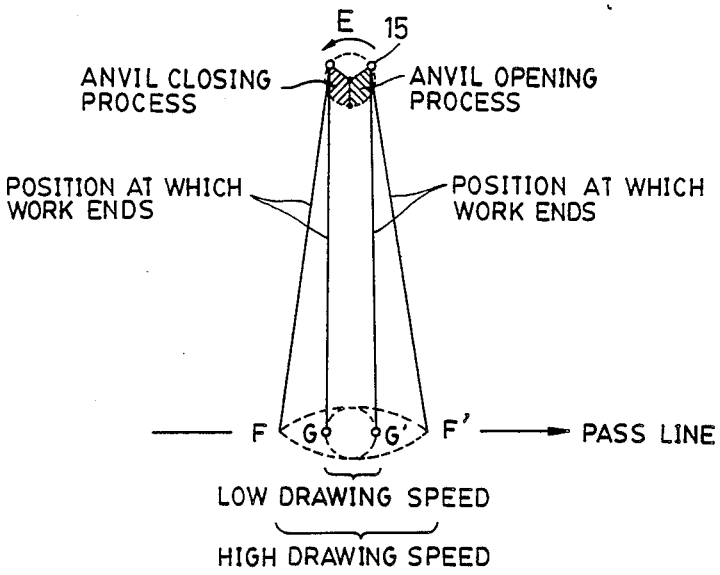
Figure 11:
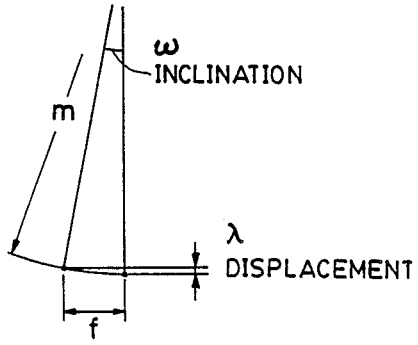
Figure 12:
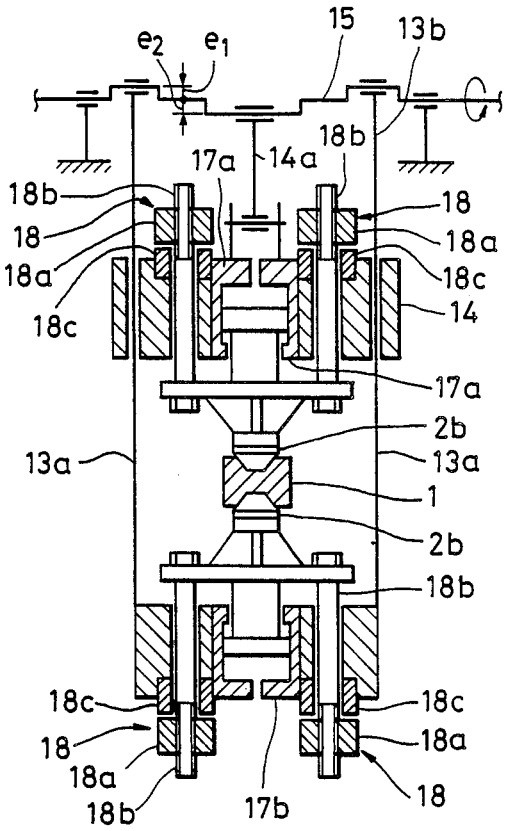
Figure 13A:
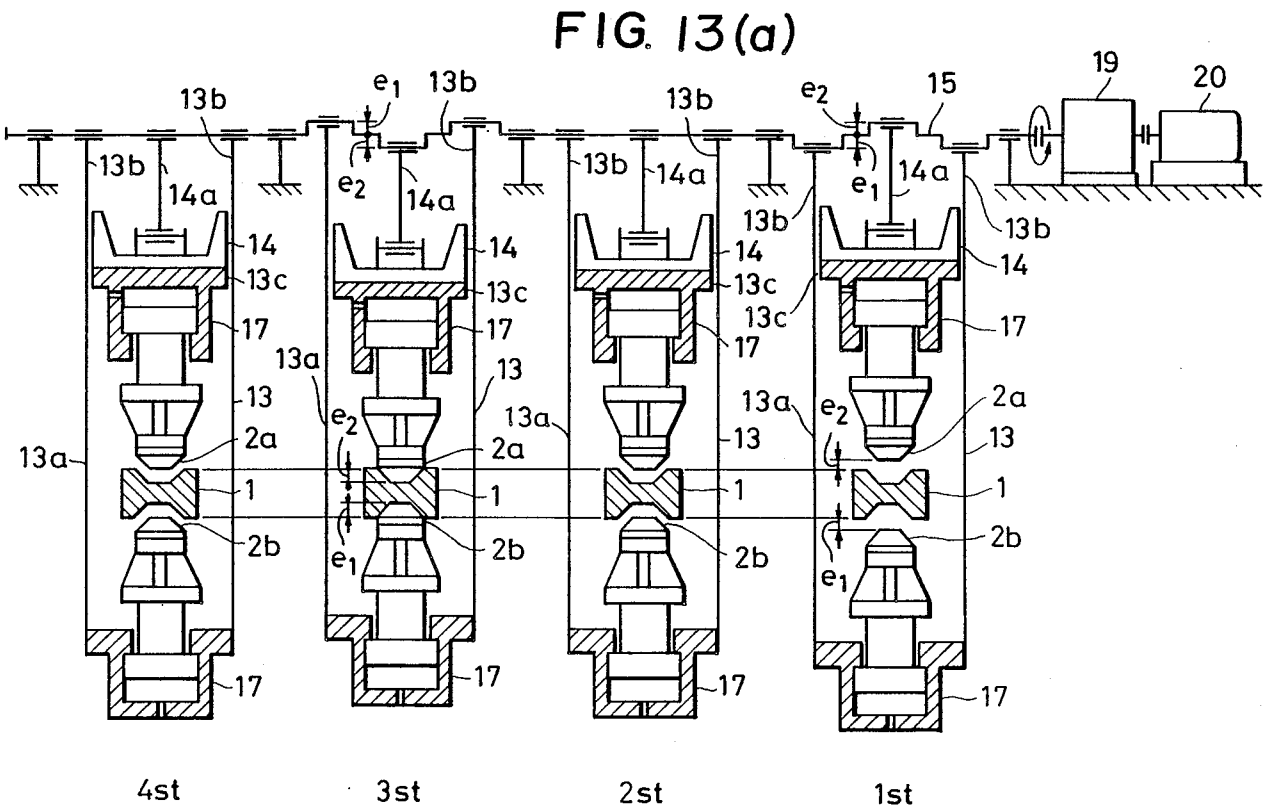
Figure 13:
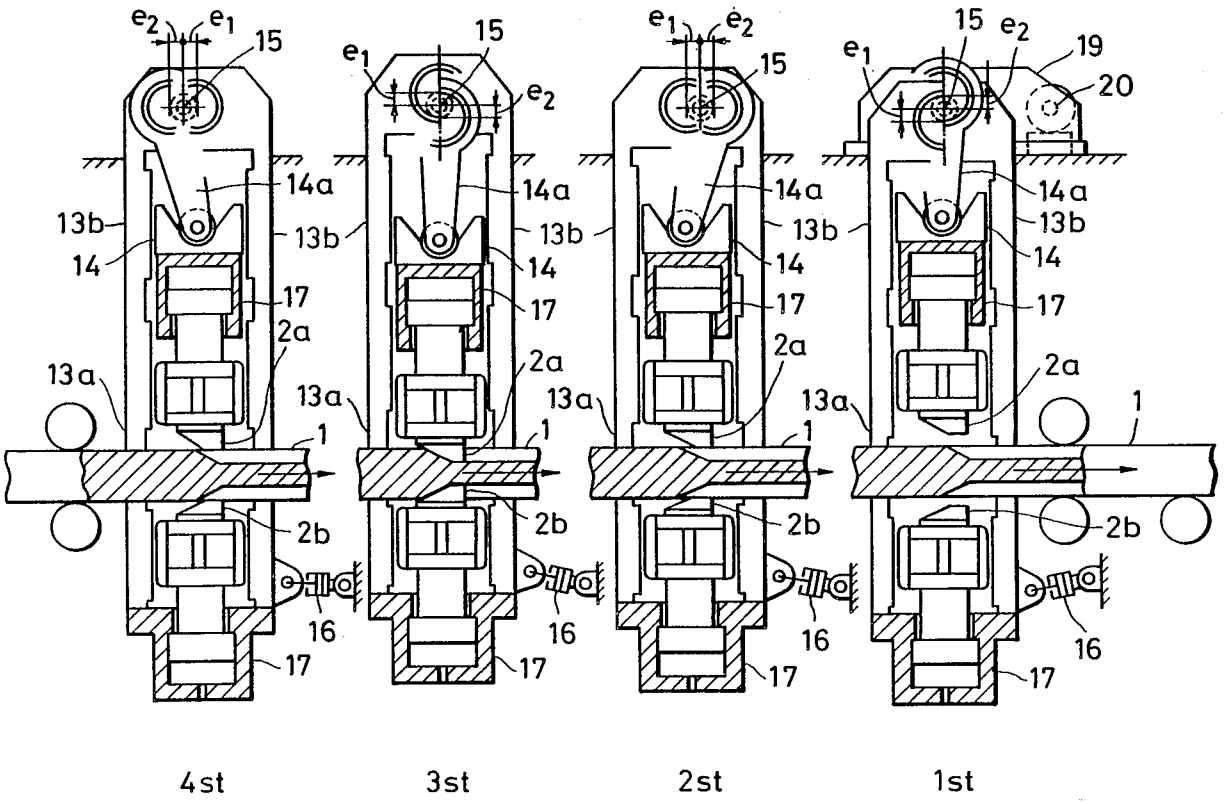
Figure 14:
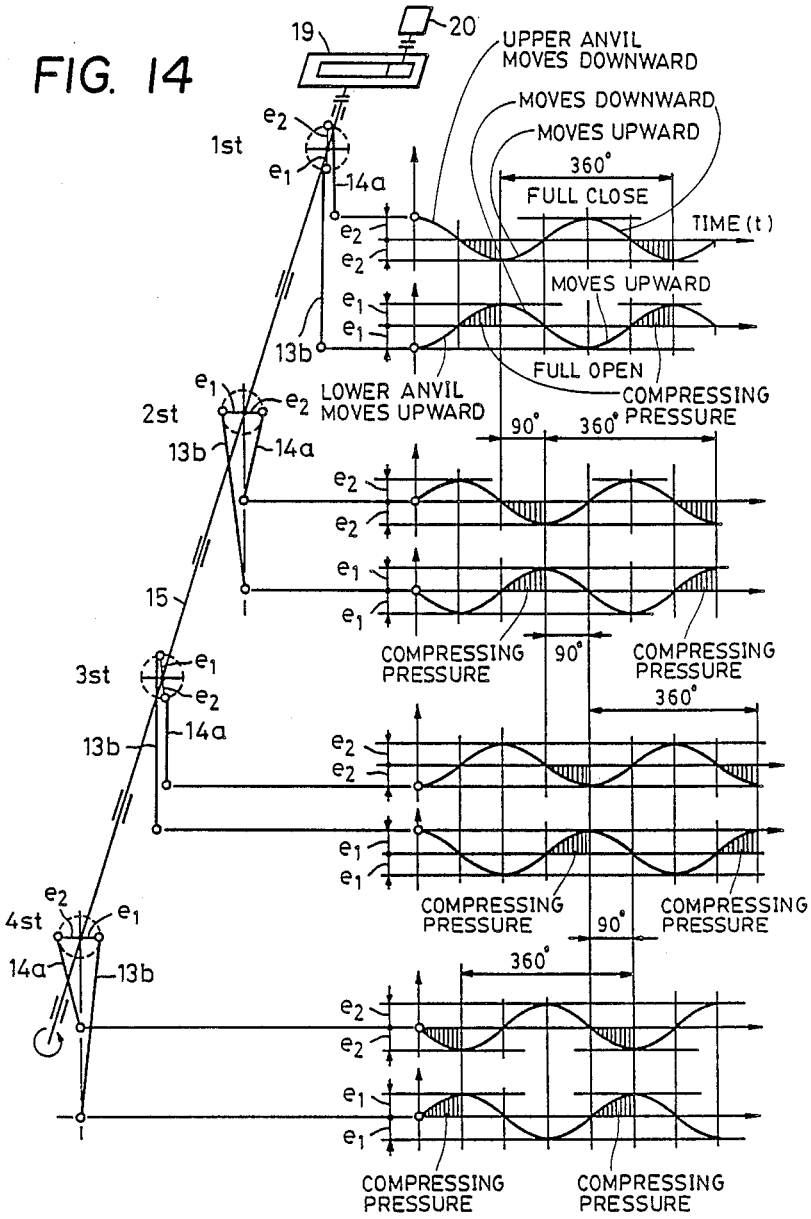
Figure 15:
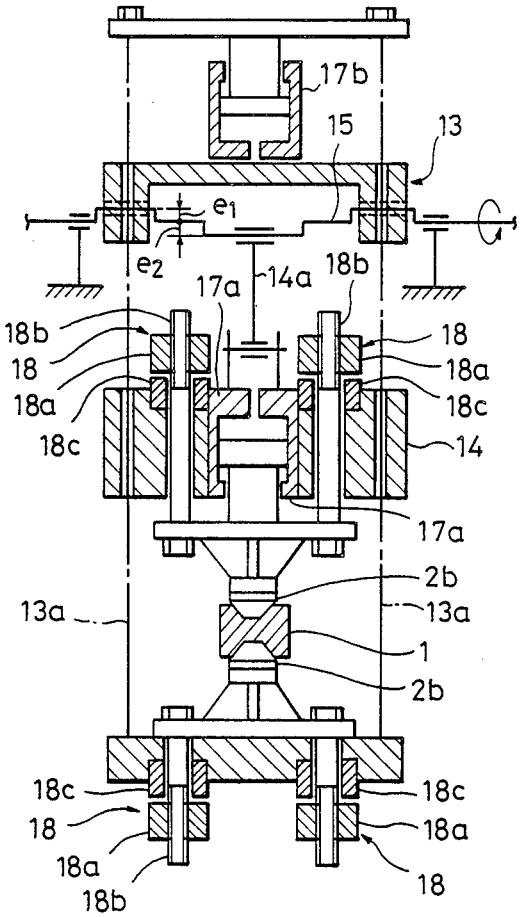

FIGS. 9(*a*) and 9(*b*) are respectively side and front structural views which illustrate a compression forging apparatus according to the present invention;

FIG. 10 is a schematic view which illustrates operation of a compression forging apparatus according to the present invention;

FIG. 11 is a view which illustrates the relationship between the follow-up distance of the apparatus and the inclination of the anvil at the time of performing compression forging;

FIG. 12 is a structural view which illustrates an apparatus according to the present invention;

FIGS. 13(*a*) and 13(*b*) are views which illustrate the case of which an apparatus according to the present invention is applied to a 4-strand continuous caster; and FIG. 14 is an operation diagram which illustrates a compression forging cycle of the apparatus shown in FIGS. 13(*a*) and 13(*b*);

FIG. 15 is another structural view which illustrates an apparatus according to the present invention.

Although specific terms will be used in the description of the invention which follows, these terms are intended to apply to the specific forms of the invention selected for illustration in the drawings, and are not intended to limit the overall scope of the invention, which is defined in the appended claims.

DETAILED DESCRIPTION OF THE INVENTION

According to the present invention, a method is provided for continuous compression forging, with compression forging anvils, the final solidified region of cast steel drawn out from a mold for continuous casting. The cast steel is compressed with said anvil at a compressing cycle which meets the following conditions:

$$t \leqq \frac{1}{2Vc\tan\theta}\left(\delta - 0.06\sqrt{D-80}\right) \quad (1)$$

where t: the compressing cycle (sec)

δ: the overall thickness reduction (mm)

Vc: the casting speed (mm/sec)

D: the cast steel thickness (mm) before compression forging

θ: the inclination angle (°) with respect to the flat surface of the anvil.

(2) A method of continuous compression forging cast steel in which an anvil having a flat surface which is in parallel to the surface of the cast steel and an inclined surface with $\theta \leqq \tan^{-1}\mu$. where μ: the coefficient of friction between the anvil and the cast steel.

(3) A method of continuous compression forging by using an anvil with a mean width which meets the requirements $$a \geqq B - 1.36D + 1.64\sqrt{D-80} + 0.182\,\delta$$

where a: the anvil mean width (mm)

B: the cast steel width (mm) before compression forging

δ: the overall thickness reduction (mm)

D: the cast steel thickness (mm) before compression forging.

In order to prevent generation of internal cracks at the time of compression-forging the continuously cast steel, it is necessary not to perform a compression that can cause an excessive tensile strain on the interface between the solidified steel and the still molten portion. Specifically, it is necessary to avoid using an anvil of a shape that can cause recessed deformation on the interface between the solidified steel and the still molten portion, or to arrange the compression forging cycle in a manner not to cause such a deformation. In a case of performing the compression by using compression-forging anvils 2 shown in FIG. 1, it is necessary for the interface between the solidified steel 1*a* and the still molten portion 1*b* not to be pressed by the inflection point A of the anvil 2 (FIG. 1) when viewed in a cross-section (to be called "section L" hereinafter) in the longitudinal direction of the continuously cast steel. That is, compression needs to be performed in such a manner that the front end point O (FIG. 1) of the solidified region of the cast steel 1 is placed in the upper stream (in the unsolidified region) to a projected point A" on the pass line of the point A (it needs to be OA"=g≧0). On the other hand, when viewed in a cross section in the direction of the width of the continuously cast steel (called "section C" hereinafter), it is necessary, as shown in FIG. 2, for the entire region of the interface between the solidified steel 1*a* and the still molten portion 1*b* to be pressed by a flat anvil, that is, the same needs to be pressed by an anvil 2 having a mean width a that can cause the compressing pressure and resulting deformation on the interface between the solidified steel and the still molten portion to be made about equal. The present invention effectively prevents forming of internal cracks during a continuous compression forging process for the continuous cast steel by arranging a proper shape of the anvil employed and by setting the compression forging conditions.

Then, specific conditions required to prevent generation of internal cracks will be described in detail hereinafter with the conditions classified into those required on the section L and the section C.

The compressing conditions at the time of performing compression forging required on the section L are shown in FIGS. 1 and 3. Since the conditions required to prevent generation of cracks are, as described above: The distance OA"=g≧0, the boundary case where g=0 is illustrated in FIG. 3. The unsolidified portion 1*b* of the cast steel 1 is compressed when the portion corresponding to the thickness of the liquid phase thereof is compressed. Assuming that the thickness of the unsolidified portion immediately below the anvil 2 is d, and that the solid phase ratio at the axis portion of the cast steel is $f_{so}$, the thickness dl corresponding to the liquid phase region can be obtained as follows since the mean solid phase ratio is $$\frac{1+fso}{2}:$$

$$dl = d\left(1 - \frac{1+fso}{2}\right) = d \cdot \frac{1-fso}{2} \tag{1}$$

The solidification ratio ($f_{so}$) of the axial portion of the cast steel is defined by an index expressing the position of the temperature of the center portion of the cast steel between a liquid phase line temperature and a solid phase line temperature, this temperature being defined in accordance with the type of steel, wherein a solidification ratio of 1.0 means a fact that the temperature is within the solidification phase temperature region, while 0.5 means a fact that the same is within the intermediate region between the liquid phase line temperature and the solid phase line temperature.

It is assumed that the interface between the solidified steel and the still molten portion is at the position at which the solidification rate is 100%, that is at the position of the solidification phase line temperature, at which no liquid phase is present, but all are in the solid phase. In general, in the interface between the solidified steel and the still molten portion the phase is not gradually changed from the solid phase to the liquid phase, but a coexist region of the solid phase and the liquid phase is present, wherein the solid phase rate is 100% at the position in the solid phase line temperature, while the liquid phase rate is 100% at the position in the liquid phase line temperature.

Then, the thickness dl corresponding to the liquid phase region can be expressed as follows when converted into a thickness $d_e$ corresponding to the liquid phase in one compression forging cycle that is compressed by one compression forging:

$$de = dl \cdot \frac{lc}{l_b} = dl \cdot \frac{lc}{l_a - lc} \tag{2}$$

where $l_a$: the contact length (mm) of the slope of the anvil in the direction L corresponding to the overall thickness reduction δ

$l_c$: the feeding pitch (mm) in one compression forging cycle $l_b$: $(l_a - l_c)$ (mm)

wherein OA"≧0 needs to be subjected to a compression forging corresponding to $d_e$ in $l_b$. Therefore, the following relationship holds in one compression forging at a feeding pitch $l_c$:

$$\frac{dl/2}{l_b} = \frac{de/2}{l_c} \rightarrow \frac{dl}{l_b} = \frac{de}{l_c}$$

$$\text{Substitution of } l_a = \frac{\delta}{2\tan\theta},\ lc = Vc \cdot t,$$

and (1) into (2) gives $$de = d \cdot \frac{1-fso}{2} \cdot \frac{Vc \cdot t}{\frac{\delta}{2\tan\theta} - Vc \cdot t} \tag{3}$$

where t: the compression forging cycle {time (sec) of one cycle}

δ: the overall thickness reduction (mm)

$V_c$: the casting speed (mm/sec)

θ: the inclination angle (°) with respect to the flat surface of the anvil.

On the other hand, a thickness reduction $\delta_e$ in one compression forging cycle to be obtained in the cast steel 1 can be expressed as follows assuming that the angle of the slope of the anvil 2 is θ:

$$\delta_e = 2 \cdot l_c \cdot \tan\theta = 2 \cdot V_c t \cdot \tan\theta \tag{4}$$

where $\delta_e$ is the thickness reduction in one compression forging cycle (mm/cycle).

Since the front point O when the ensuing compression forging starts needs to be on the portion rather adjacent to the unsolidified region compared to A" in order to prevent generation of internal cracks, it is necessary for the front end point O' at the completion point of the compression to be positioned forward at least by $l_c$ than A". That is, it is necessary for preventing generation of internal cracks to have a thickness $d_e$ of the liquid phase in the unsolidified portion which is positioned forward by $l_c$ by the thickness reduction $\delta_e$ caused by one forced compression, and thereby to have the interface between the solidified steel and the still molten portion move ahead.

$$\delta_e \geqq d_e \tag{5}$$

Substitution of (3) and (4) into (5), and rearrangement terms on t gives (6)

$$t \leqq \frac{1}{2\,Vc\tan\theta}\left(\delta - d\frac{1-f_{so}}{2}\right) \tag{6}$$

The thus-obtained equation represents the conditions required for the compressing cycle to prevent generation of internal cracks.

When an improvement in the internal quality such as prevention of generation of central segregations is intended, the following conditions need to be satisfied additionally. That is, the thickness d of the unsolidified phase with respect to the flow of the cast steel 1 to be compressed needs to be within the following range:

$$1.2\sqrt{D-80} \leqq d \leqq 10\sqrt{D-80} \tag{7}$$

Furthermore, the solid phase ratio $f_{so}$ at the central portion of the cast steel needs to be within the following range:

$$0.5 \leqq f_{so} \leqq 0.9 \tag{8}$$

Substitution of $(d)_{min}=1.2\sqrt{D-80}$ and $(f_{so})_{max}=0.9$ into (6) for the purpose of obtaining the upper limit of t gives $$t \leqq \frac{1}{2\,Vc\tan\theta}\left(\delta - 0.06\sqrt{D-80}\right) \tag{9}$$

That is, a compression forging cycle performed with the anvil 2 to improve the internal quality and to prevent generation of internal cracks can be obtained from equation (9).

Since the lower limit is defined by the response characteristics of the compression forging action and the institution cost of the hardware: the compression forging machine, and therefore is regardless of the quality of the products, it is not specified here.

Figure 4:
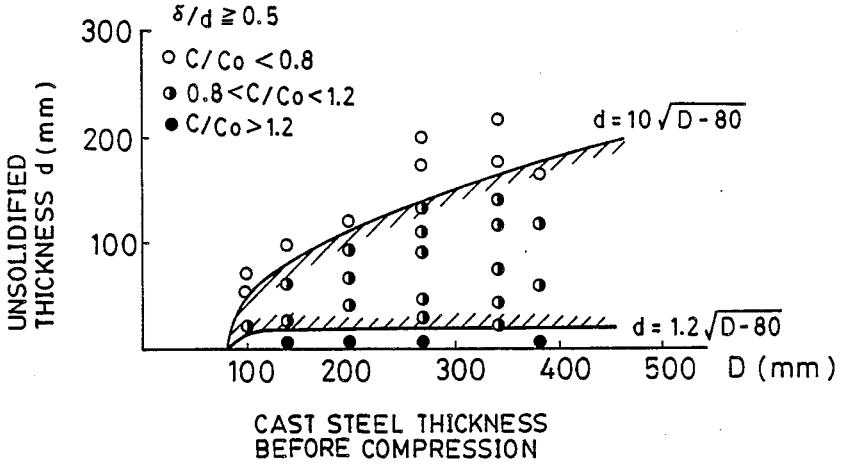
FIG. 4 is a graph which illustrates central segregation generated on the basis of the relationship between the cast steel thickness D and unsolidified thickness d before compression.
Figure 5:
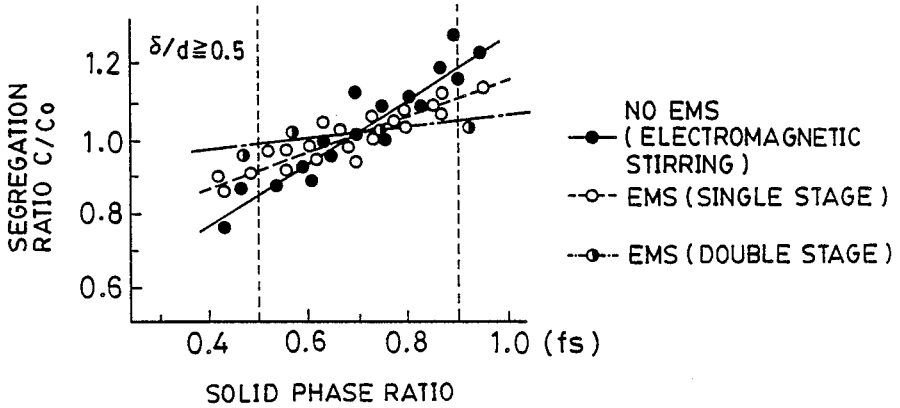
FIG. 5 is a graph which illustrates the relationship between the solid phase ratio at the central portion of the cast steel before compression and segregation ratio.

The above-described equation (7) is obtained as a result of an examination upon a carbon segregation ratio (C/Co) where C: carbon content of the particular portion; Co: average content of carbon with respect to the relationship between the cast steel thickness D and unsolidified thickness d of the cast steel 1 before performing compression under conditions $\delta/d \geqq 0.5$, and as shown in FIG. 4, the unsolidified thickness d is the preferred region in which the range in equation (7) displays the minimum normal segregation and negative segregation. The above-described equation (8) is obtained as a result of an examination upon the relationship between the solid phase ratio $f_{so}$ of the cast steel at the compressed position and the carbon segregation ratio (C/Co) at the thickness center when the cast steel 1 is compressed under conditions $\delta/d \geqq 0.5$. As shown in FIG. 5, the ideal condition for making C/Co=1 in compression forging is when the solid phase ratio $f_{so}=0.7$. With the allowable rate of C/Co defined from the properties of the products considered, it was found that it is preferable to perform compression in the range where the solid phase ratio $(f_{so})=0.5$ to 0.9 for preventing internal cracking and negative segregation.

Furthermore, the inclination angle $\theta$ of the above-described anvil 2 needs to be determined to be smaller than a frictional angle $\tan^{-1}\mu$ at the forging surface for the purpose of preventing slippage on the surface of the cast steel 1 when this cast steel 1 is compressed.

On the other hand, the conditions required to be realized on the cross-section C need to be arranged in such a manner that the width of the anvil 2 is determined as to have the compression force of the anvil 2 applied substantially equally to the unsolidified width b of the cast steel 1 as shown in FIG. 2, where the width of the anvil 2 is arranged to be the mean width a of the portion to be compressed. For example, in a case of a trapezoidal anvil as illustrated, the anvil width a with respect to the overall thickness reduction $\delta/4$ will represent the anvil width. As for the unsolidified width b, assuming that the solidifying speeds are the same at both longer and the shorter sides of the same, the thickness of the solidified portion from either side holds $$\frac{B-b}{2} = \frac{D-d}{2}.$$

Therefore, $$b = B - D + d \tag{10}$$

The compressing force obtained from the anvil 2 can be determined as follows: assuming that the broadening angle of a load to be substantially equally applied to the inside is $\beta$, the effective width f of the load to be applied to the interface between the solidified steel and the still molten portion can be expressed as follows:

$$f = a + 2s\tan\beta \tag{11}$$

where $$2s = D - d - \frac{\delta}{2}, \text{ therefore,} \tag{12}$$

$$f = a + \left(D - d - \frac{\delta}{2}\right)\tan\beta$$

Since the conditions required for preventing generation of internal crack is $f \geqq b$, the following relationship holds from (10) and (12):

$$a + \left(D - d - \frac{\delta}{2}\right)\tan\beta \geqq B - D + d \tag{13}$$

Therefore, $$a \geqq B - D + d\left(D - d - \frac{\delta}{2}\right)\tan\beta$$

where

B: the cast steel width (mm) before compression forging d: the unsolidified thickness (mm)

s: the distance between the position at which the anvil mean width a in the thickness direction of the cast steel at the position to be compressed and the interface between the solidified steel and the still molten portion:

Furthermore, symbol c of FIG. 2 represents the width of the flat portion of the anvil.

Furthermore, in order to determine the lower limit of the mean anvil width a in terms of the improvement in the internal quality of products, in needs for the condition of the above-described equation (7): $(d)_{min}=1.2\sqrt{D-80}$ to be substituted into equation (13).

The widening angle of the load $\beta$ of substantially 20° was obtained from the results of experiments. Therefore, equation (13) can be rearranged to be:

$$a \geqq B - D + 1.2\sqrt{D-80} - \left(D - 1.2\sqrt{D-80} - \frac{\delta}{2}\right)$$

tan 20°, therefore, $$a \geqq B - 1.36D + 1.64\sqrt{D-80} + 0.182\,\delta \qquad (14)$$

That is, by arranging the mean compression width a of the anvil to satisfy equation (14), internal cracks on the cross-section C can be prevented, and also the internal quality can be improved.

Hereinafter the most suitable continuous compression forging apparatus for compressing the cast steel by using the above-described compression forging anvil will be described.

A continuous compression forging machine according to the present invention for continuous compression forging continuously cast steel comprises: at least a pair of anvils for vertically holding the pass line of cast steel drawn out from a mold for continuous casting and continuously compression-forging the final solidified region of the moving cast steel; means causing their movement toward and away from each other; a frame; a slider; and links, wherein either of said anvils is disposed within said frame and has a port through which said cast steel is introduced, another anvil is secured to said slider which can be reciprocated along a sliding surface formed in said frame, and said frame and said slider are hung from a crank shaft via said links, said crank shaft acting to move said anvils toward and away from each other.

It is preferable in terms of compression forging efficiency for the compression forging apparatus with the above-described structure to be arranged to provide a means for restoring the frame and the slider to the initial state when the anvils are positioned away from each other. Furthermore, the anvils are preferably provided with a position adjusting means capable of individually adjusting the overall thickness reduction. More particularly, it is preferable for the anvils to be provided with a position adjusting means comprising a hydraulic cylinder and a stopper for restricting the stroke of this cylinder.

In the present invention, it is considerably effective to provide a multi-strand continuous casting machine capable of making a plurality of cast steel blocks arranged in such a manner that plural compression forging apparatuses having the above-described structure are disposed in accordance with the positions of each of the strands, and the thus-disposed compression forging apparatuses are hung from a single crank shaft with the compression forging cycle arranged in such a manner that the starts of the compression forging operations of the respective strands do not coincide.

One structure of a compression forging apparatus according to the present invention is schematically shown in FIGS. 9(*a*) and 9(*b*). Reference numeral 1 represents cast steel drawn out from a mold for performing the continuous casting, and **2*a* and 2*b* represent anvils. These anvils 2*a* and 2*b* vertically hold the pass line of the cast steel 1 and continuously compression-forge the final solidified region of the cast steel 1 by their movement toward and away from each other. Reference numeral 13 represents a frame having an inlet port 13*a* through which the cast steel 1 is introduced, and in which either of the two anvils 2*a* or 2*b* is disposed therein (the anvil 2*b* is so disposed here). Reference numeral 14 represents a slider capable of vertically and reciprocally moving along a sliding surface 13*c* formed in the frame 13, this slider 14 being provided with the other anvil 2*a* at the front end surface thereof. Reference numeral 15 represents a crank shaft which acts to make the anvils 2*a* and 2*b* move toward or away from each other. Thus, the frame 13 and the slider 14 are hung from the crank shaft 15 with the corresponding links 13*b* and 14*a***.

When the crank shaft 15 supporting the frame 13 and the slider 14 in a pendulum manner is revolved by a motor 20 or the like via, for example, a decelerator 19, the anvils **2*a* and 2*b* connected to the links 13*b* and 14*a* via the frame 13 and the slider 14 repeat the opening and closing movement centering the pass line since the links 13*b* and 14*a* are made eccentric with respect to the rotational axis of the crank shaft 15 by distances $e_1$ and $e_2$. Thus, the cast steel 1 is continuously subjected to compression forging by the relative movement of the anvils 2*a* and 2*b*** coming closer and away from each other.

In this compression forging process caused by the movement of the anvils **2*a* and 2*b*, since the apparatus body can readily follow the drawing-out movement of the cast steel 1**, the apparatus can be protected from any excessive force.

FIG. 10 is a view which illustrates the relationship between the locus of an anvil, for example, the anvil 2, and the feed of the cast steel 1 when the crank shaft is rotated in a direction designated by an arrow E. This feed is illustrated as classified into a case where the drawing speed of the cast steel 1 is raised and a case where the same is lowered (it is the same if the rotational speed of the crank shaft 15 is varied and the drawing speed of the cast steel 1 is set to a constant speed) with rotational speed of the crank shaft 15 set to a constant speed. As illustrated, the anvil **2*a* moves from F to F′ when the drawing speed is a relatively high speed, while the same moves from G to G′ when the same is a relatively low speed. However, the overall thickness reduction becomes the same in either case. In this case, the path followed by the apparatus body is described as the above-described locus, but the cast steel 1 is moved horizontally due to the drawing. There arises a fear that an excessive force might be applied to the cast steel 1** or the apparatus during the compression forging. However, since the follow-up distance of the apparatus is practically limited to several tens mm in practice, such problem can be overcome by securing the length of the pendulum at least 3 m.

The anvil inclination angle $\omega$ becomes, as shown in FIG. 11, a reduced degree: 30/3,000=1/100, provided that the follow-up distance f is 30 mm. The influence of this inclination on the overall thickness reduction of the anvils is limited to a reduced value expressed regarding the height displacement $\lambda$:

$3000\ \text{mm}\times[1-\sqrt{1-(1/100)^2}]$=approximately 0.15 (0.1 to 0.2 mm), where m represents the length of the pendulum of the anvil. The height displacement is limited within the clearance of the apparatus, causing no problem.

According to the present invention, the compression forging apparatus which has been moved as a result of the drawing of the cast steel 1 at the time of performing compression forging can be quickly restored to its original position by providing a hydraulic means 16 (FIGS. 9(*a*) and 13(*b*)), for example, a hydraulic cylinder, for the frame 13. Furthermore, the anvils 2*a* and 2*b* can be used as a relief mechanism from abnormal loads if they are secured, as a position-adjusting means, to the frame 13 and the slider 14 via, for example, the hydraulic cylinder 17. In addition, the cast steel 1 can be made to pass through the gap between the anvils 2*a* and 2*b* when the gap is widened in an emergency. Furthermore, an advantage can be obtained in that the work for changing the size of the cast steel 1 can be readily performed.

In addition, a simple and mechanical adjusting means can be realized without any necessity of providing an expensive hydraulic servo system by arranging, as shown in FIG. 12, the structure in such a manner that the above-described position adjusting means comprises an electric or manual abutting stopper 18 and hydraulic cylinders 17*a* and 17*b*, the stopper 18 comprising the nut 18*a*, a screw 18*b*, and an absorbing member 18*c*.

In the compression forging apparatus having the structure as shown in FIG. 15, the position adjusting means of the lower anvil 2*b* can be easily broken due to heat, water, or scale generated during operation, and its maintenance is difficult to be conducted. In order to overcome this, the hydraulic pressure cylinder 17 which serves as the position adjusting means needs, as shown in FIGS. 13(*a*) and (*b*), to be disposed above the main frame body 13 (upper than the crank shaft) and as well the main frame body 13 needs to be connected to the crank shaft 15 with the anvil 2*b* supported via this position adjusting means.

When the apparatus according to the present invention is applied to, for example, a multi-strand continuous caster, the above-described devices shown in FIG. 9 are respectively provided to correspond to strands, and are hung from one crank shaft so as to realize a compressing cycle with which the start of the compression forging for each of the strands cannot become the same, for example, so as to make the phase difference 180° in a case of 2-strand, 120° in a case of 3-strand, and 90° in a case of 4-strand.

FIGS. 13(*a*) and 13(*b*) are views which schematically illustrate the case of a 4-strand continuous caster. FIG. 14 is a view which illustrates an operation diagram of the crank shaft 15 of FIGS. 13(*a*) and (*b*). Although the case is described in which the compression forging apparatus is disposed above the pass line of the crank shaft for hanging, and the motor and decelerator for rotating this crank shaft, it may disposed below the pass line if there is sufficient space.

Internal cracks formed upon actual compression forging performed under various conditions with a press forging apparatus as shown in FIGS. 8 to 15 were examined.

EXAMPLE 1

(examination of the internal cracks observed on the cross-section L)

Figure 6:
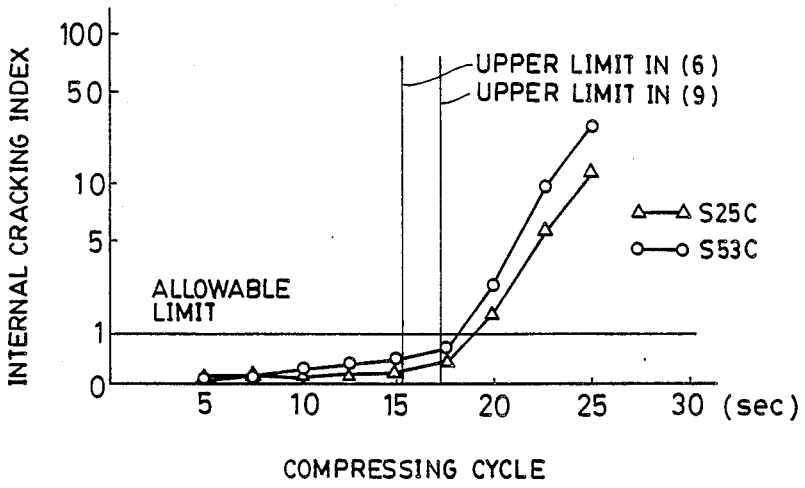
FIG. 6 is a graph which illustrates the relationship between the compression cycle and the internal cracking index.

Casting was performed under conditions that a bloom of cast steel S53C (C: 0.53%, Si: 0.19%, Mn: 0.81%, S: 0.015%, P: 0.025%) of thickness 270 mm, width 340 mm, and a bloom of cast steel S25C ((C: 0.25%, Si: 0.20%, Mn: 0.58%, S: 0.010%, P: 0.012%) were used, and the overall thickness reduction $\delta=40$ mm, the casting speed $V_c=0.72$ m/min, the unsolidified thickness d=16 mm, the solid phase rate $f_{so}$ at the central portion $f_{so}=0.8$, the inclination of the anvil $\theta=6°$ with the compression forging cycle varied in a range t=5 to 25 sec. The results are shown in FIG. 6. The axis of ordinate of this drawing represents the index (reference is set to 1) obtained by dividing the overall length of the internal cracks observed in a sulfur print test carried out upon the sample of the 600 mm long cross-section L after compression forging by the overall length of the allowable limit of the internal cracks of the sample. Referring to this graph, the compression cycles 16.3 sec and 15.2 sec for preventing internal cracks obtained from equations (9) and (6) are shown. As is shown in this graph, since these compression cycles approximate to 18 sec and are smaller than this 18 sec, it is apparent that they can serve as the evaluation equation. Since the compression forging was performed under conditions which are relatively approximate to the design conditions of equation (9), the values from equations (9) and (6) did not display a significant difference in this example. However, in practice, it is preferable to perform the evaluation with equation (6) since further elaborate conditions can be reflected thereto.

EXAMPLE 2

(examination of the internal cracks observed on the cross-section C)

Figure 7:
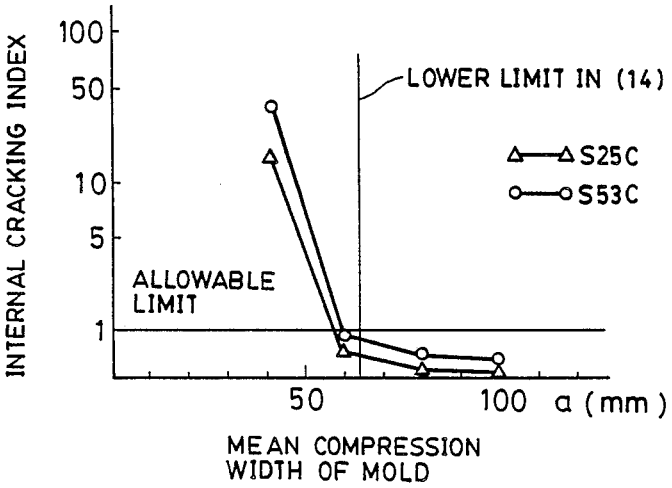
FIG. 7 is a graph which illustrates the relationship between the compression mean width a of the anvil and the internal cracking index.
Figure 8:
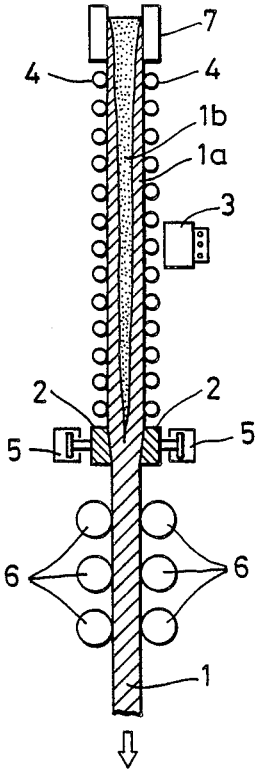
FIG. 8 is a schematic view which illustrates a continuous caster provided with a compression forging apparatus.

Compression forging was performed with a bloom of S53C and S25C 400 mm thick, 560 mm wide under conditions that the overall thickness reduction $\delta=100$ mm and unsolidified thickness d=21 mm with the compression mean width a of the anvil varied at 40, 60, 80, and 100 mm. The results are shown in FIG. 7. In the case of the anvil width of 60 mm, the result approximated the limit with respect to the anvil mean width a of 64 mm obtained from equation (14), and no problem of internal cracks arose when the anvil width was 80 mm or more. Therefore, the compression width a of the anvil of equation (14) can be satisfactory and practically used as the evaluation equation for internal cracks. Consequently the advantage of the present invention was confirmed.

According to the present invention and with determining the compression forging conditions and the shape of the anvil, the internal cracks of the cast steel when the same is compression forged can be prevented. In addition, the internal defects such as central segregations can be improved. As a result, a significant improvement can be obtained with respect to the product manufactured by the conventional continuous casting.

In addition, when cast steel 250 mm thick and 300 mm in width was cast at a casting speed of 1.1 m/min by using 3-strand continuous caster, the central segregations and center porosity can be effectively reduced from the obtained cast steel.

Furthermore, a comparison upon the institutional cost and the life of the conventional hydraulic direction drive system was made, and the following results were obtained:

(1) The institutional cost was reduced by 30%.
(2) The maintenance load was reduced to 1/10.
(3) The running cost was reduced by 20%.
(4) The noise level was reduced to 50 phons of loudness level with respect to the estimated value of 110 phons with the conventional hydraulic system.

Consequently, the apparatus according to the present invention displays significant advantages with respect to the conventional apparatus. Therefore, a significantly smooth operation can be achieved according to the present invention.

While the present invention has been disclosed in terms of selected preferred embodiments in order to facilitate better understanding of the invention, it should be appreciated that the invention can be embodied in various ways without departing from the principles of the invention. Therefore, the invention should be understood to include all possible embodiments and modifications without departing from the spirit of the invention set out in appended claims.

What is claimed is:

1. In a method of continuous compression forging, with a compression forging anvil, cast steel drawn from a continuous casting mold, the step which comprises:

compressing said cast steel with said anvil using a compressing cycle which meets the following conditions:

$$t \leqq \frac{1}{2Vc\tan\theta}(\delta - 0.06\sqrt{D-80})$$

where
t: the compressing cycle (sec)
δ: the overall thickness reduction (mm)
$V_c$: the casting speed (mm/sec)
D: the cast steel thickness (mm) before compressing forging, and
θ: the inclination angle (°) with respect to the flat surface of the anvil.

2. A method of continuous compression forging continuously cast steel according to claim 1, wherein said cast steel is compressed by an anvil having an inclination angle which meets the following conditions:

$$\theta \leqq \tan^{-1}\mu$$

where
μ: coefficient of friction between the anvil and the cast steel.

3. A method of continuous compression forging, with a compression forging anvil, the final solidified region of cast steel drawn from a continuous casting mold, said method comprising the step of:

compressing said cast steel by pressing it with an anvil having a mean compression width which meets the following conditions:

$$a \geqq B - 1.36D + 1.64\sqrt{D-80} + 0.182\,\delta$$

where
a: the anvil mean width (mm)
B: the cast steel width (mm) before compression forging
δ: the overall thickness reduction (mm)
D: the cast steel thickness (mm) before compression forging.

4. A method of continuous compression forging continuously cast steel according to claim 3, wherein said cast steel is compressed by an anvil whose mean compression width a (a) meets the condition $\geqq B-1.36D+1.64\sqrt{D-80}+0.182\,\delta$.

5. An apparatus for continuous compression forging continuously cast steel comprising:

at least a pair of anvils positioned for vertically holding the pass line of cast steel drawn out from a mold for continuous casting, and for continuously compression-forging the moving cast steel; means for adjusting the movement of said anvils toward and away from each other;
a frame;
a slider; and
links, connected so that either of said anvils is disposed within said frame which has a port through which said cast steel is introduced, another anvil is secured to said slider which can be reciprocated along a sliding surface formed in said frame, and said frame and said slider are connected to a crank shaft via said links, said crank shaft being connected to move said anvils toward and away from each other.

6. An apparatus for compression forging continuously cast steel according to claim 5, wherein restoring means is provided for said main frame body, said means being connected to restore the initial state of said frame which has moved in the forward direction of said cast steel during every compression forging process cycle due to the movement of said anvils toward and away from each other, said frame being restored with said slider, anvils and links.

7. An apparatus for compression forging continuously cast steel according either off claim 5 or 6, wherein position adjusting means capable of adjusting the overall thickness reduction is provided for said anvils for vertically holding the pass line of said cast steel.

8. An apparatus for compression forging continuously cast steel according to claim 7, wherein said position adjusting means capable of adjusting the overall thickness reduction comprises a hydraulic cylinder and a stopper for restricting the stroke of said hydraulic cylinder.

9. An apparatus for compression forging continuously cast steel strand, which apparatus includes at least a pair of anvils for vertically holding the pass line of said cast steel strand drawn out from a mold for continuous casting as to continuously compression-forge the final solidified region of the moving cast steel strand by their movement toward and away form each other, said apparatus being characterized in that:
a lower anvil is disposed within a main frame body which has a port through which said cast steel strand is introduced;
an upper anvil is secured to a slider which can be reciprocated along a guide formed in said main frame body; and
said slider is hung from a crank shaft via links, said crank shaft acting to move said anvils toward and away from each other, and said main frame body being connected to said crank shaft via a position adjusting means disposed in the upper portion of said main frame body.

10. An apparatus for continuous compression forging continuously cast steel strands, said apparatus including a plurality of pairs of anvils for vertically holding the pass lines of said cast steel strands drawn out from a continuous multi-strand caster in a manner to continuously compression-forge the final solidified regions of the moving cast steel strands by their movements toward and away from each other, said apparatus being characterized in that:

either of said anvils is disposed within a main frame body which has a port through which said cast steel strand is introduced, another anvil is secured to a slider which can be reciprocated along a guide formed in said main frame body; and said main frame body and said slider are respectively hung from a crank shaft via links, said crank shaft acting to move said anvils toward and away from each other and capable of realizing a compression cycle with which the start of the compression forging step performed by each of said anvils does not coincide.

* * * * *